US005153955A

United States Patent [19]

Singleton, Jr. et al.

[11] Patent Number: 5,153,955

[45] Date of Patent: Oct. 13, 1992

[54] HAMMOCK STAND

[76] Inventors: Albert L. Singleton, Jr., P.O. Box 1602; Jesse A. Branch, III, P.O. Box 1209, both of Greenville, N.C. 27834

[21] Appl. No.: 745,220

[22] Filed: Aug. 14, 1991

[51] Int. Cl.[5] ..... A45F 3/24

[52] U.S. Cl. ..... 5/127

[58] Field of Search ..... 5/127, 128, 129, 130, 5/120

[56] References Cited

U.S. PATENT DOCUMENTS 679,963 8/1901 Mayward ..... 5/129
944,661 12/1909 Buck ..... 5/127

FOREIGN PATENT DOCUMENTS 2422505 11/1975 Fed. Rep. of Germany ..... 5/127
705671 6/1931 France ..... 5/129
127841 4/1950 Sweden ..... 5/129

*Primary Examiner*—Alexander Grosz
*Attorney, Agent, or Firm*—J. W. Gipple

[57] ABSTRACT

A hammock stand is provided for suspending a hammock above the ground. The stand is a curved arch consisting of three sections which are joined together with tongue and grooves joints that are reinforced by fasteners and provided with a base to maintain the arch in an upright orientation.

2 Claims, 3 Drawing Sheets

HAMMOCK STAND

SUMMARY OF THE INVENTION

The present invention is directly to a composite stand for supporting a hammock in a suspended configuration above the ground. The stand is a curved three piece elongated composite which forms an upturned arch between whose ends the hammock is suspended. Transverse supports are provided at the base to maintain the stand in an upright configuration during use.

BACKGROUND OF THE INVENTION

Hammocks are one of the least expensive, oldest, and most convenient of devices for accommodating individuals in a reclining position. Traditionally, hammocks have been strung between trees, upright poles, and other convenient, relatively stable structures. It has frequently developed however, that the very environments which are most desirable and conducive to the use of a hammock such as the beach or open sunny area of the yard are generally devoid of suitable structures to which the ends of a hammock can be attached. Accordingly, various devices have been proposed to provide the necessary structure for suspending a hammock from its two ends so that it is maintained in a configuration where it swings freely above the ground. Of necessity such structures must be quite large since they must not only accommodate between their ends the fully extended hammock itself but also a reasonable length at either end of rope or chain to permit the hammock to assume a comfortable position and swing freely. Thus, stands which have been proposed for supporting hammocks have generally been large bulky devices which must in some manner be collapsed for shipment.

It has, for example, been proposed to provide a large elongated arch which stands upright on the ground and supports the hammock between its two ends. Such devices have however, constituted of the large number of pieces which had to be bolted together to form the extended arch. Typically, for example, such devices have consisted of two curved end sections which are joined by a pair of parallel elongated central pieces to form the extended arch. Yet an additional system has consisted of only two curved sections which are overlapped and bolted together to form a large extended arch. This latter system however, has the disadvantage that each of the respective two sections must be of considerable length in its self in order that the two sections when joined together will have sufficient dimensions to accommodate the hammock.

There is, accordingly, a need for a hammock stand which only provides a stable, attractive and functional means for suspending a hammock above the ground but which also does not require either a large number of sections or sections which are themselves of large dimensions so that they complicate the shipping of the device prior to assembly.

There is yet a further need to provide a support stand for a hammock which combines the features of attractiveness with physical strength, ease of assembly, and compactness of size and weight in its disassembled state.

DETAILED DESCRIPTION OF THE INVENTION

In accordance with the present invention, a stand is provided for supporting a hammock in a suspended configuration above the ground. The device of the invention consists of a curved, elongated composite member consisting of a curved central section which is joined in interlocking engagement at each of its respective ends with one end each of respective curved end sections to form a unitary elongated member having the configuration of an upturned arch. The device of the present invention is provided with a plurality of elongated supports which are mounted transverse to the curved elongated composite member to maintain the member in an upright orientation. Each end section is provided at its unattached end with means for attaching one end of the hammock. Preferably, the interlocking engagement of the respective sections which form the composite arch of the invention is a tongue and groove joint in which the ends of the central section fit within slots provided in the respective ends of the ends sections. Thus, the device of the present invention is formed from a composite of three interlocking members plus the transverse supports and requires relatively little space for shipment prior to assembly. The device of the present invention will however, be more fully appreciated by having reference to the drawings apended hereto.

Figure 4:
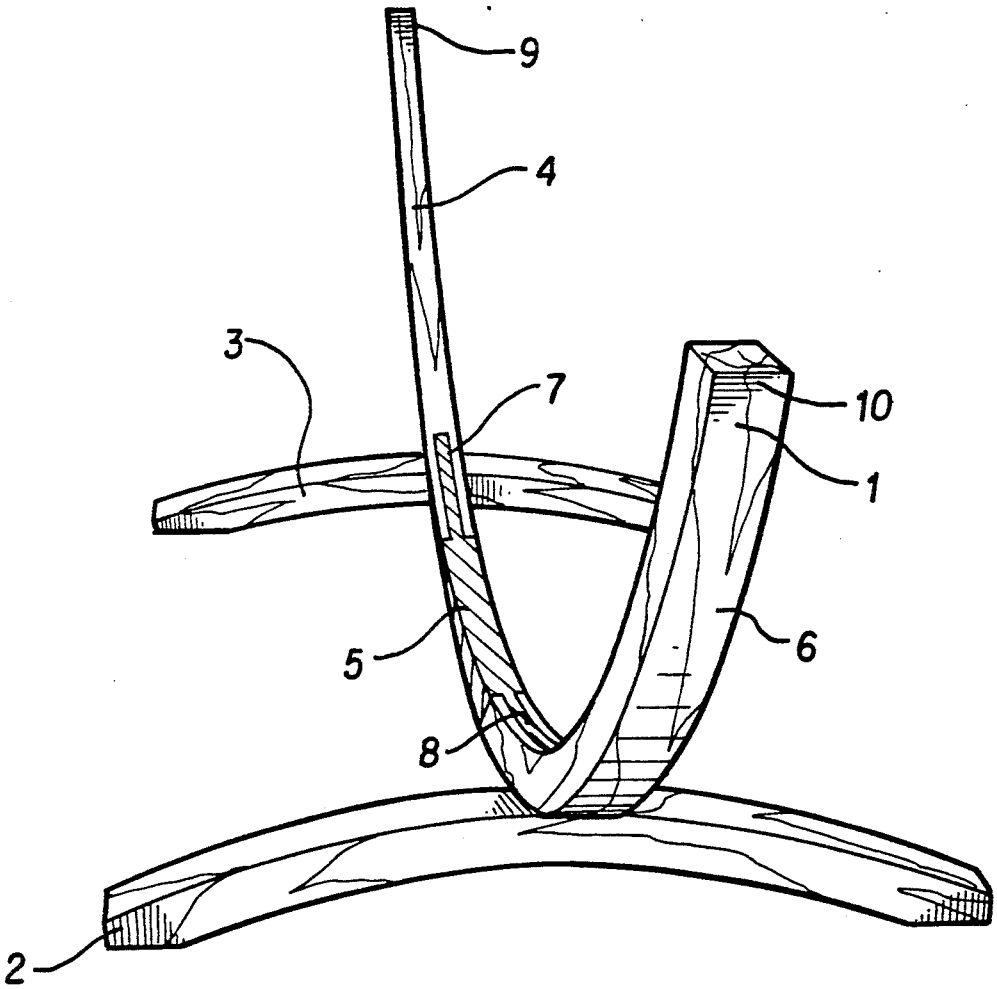
FIG. 4 illustrates an upright assembled configuration the device of the present invention.
Figure 5:
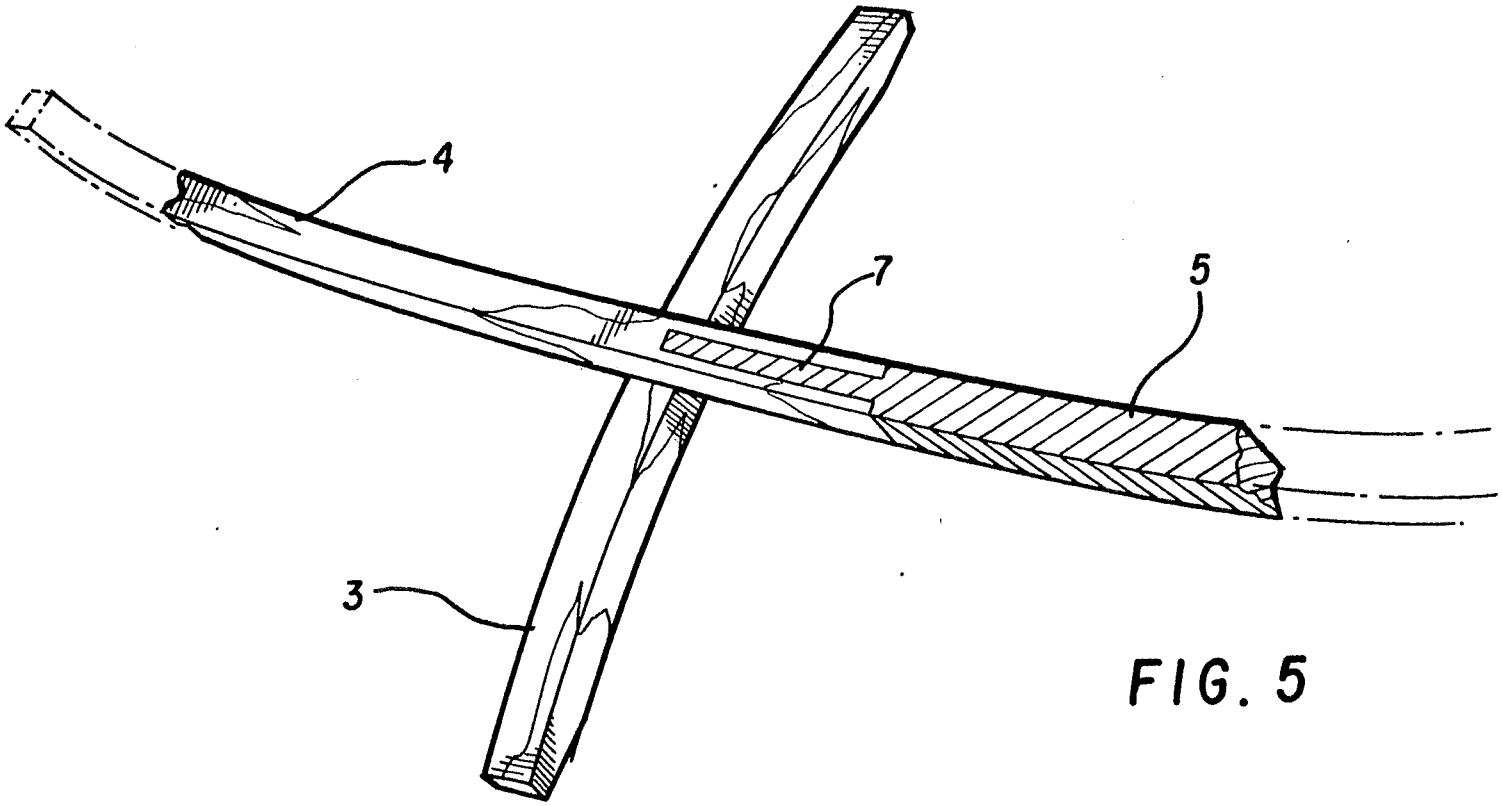
FIG. 5 illustrates in greater detail the interlocking assembly of the device of the present invention illustrated in FIG. 4.

Directing attention initially to FIGS. 4 and 5 of the drawing, the support stand of the present invention is illustrated in an upright configuration at 1 consisting of interlocking sections 4,5 and 6 respectively. Transverse supports are shown at 2 and 3 for maintaining the device in a stable upright configuration suitable for suspending a hammock so that it swings freely above the ground. The respective curved elongated interlocking sections 4,5, and 6 are engaged with one another at 7 and 8. Although, not specifically illustrated in FIGS. 4 and 5 of the drawings means are provided at ends 9 and 10 of the structure for attaching the ends of the hammock or flexible connectors attached to the ends of the hammock such as ropes or chains.

At FIG. 5 the engagement of the respective elongated curved sections which form the unitary composite 1 are illustrated in greater detail. The central curved section 5 is shown in tongue and groove engagement at 7 with the slotted end of the end section 4. It will be appreciated that once this engagement is made it can either be permanently secured by means of adhesive or other fasteners or can be secured by removable bolts or other fasteners. Thus, the entire curved structure 1 between whose ends the hammock is suspended consists of a composite three section member whose sections are securely joined in interlocking arrangement. Added stability and strength are provided by having the transverse supports 3 and 2 actually engage the curved composite member at approximately the points where the respective sections are joined together.

Figure 1:
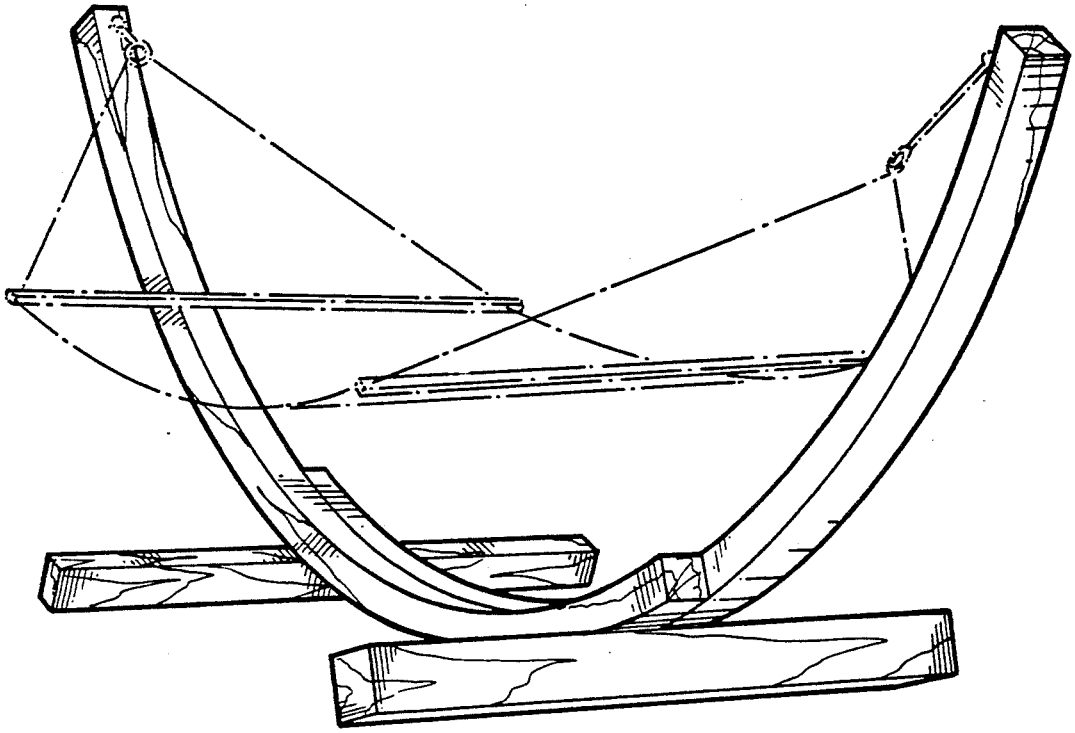
FIG. 1 PRIOR ART
FIG. 1 illustrates a hammock stand of the prior art in assembled configuration with a hammock attached thereto
Figure 2:
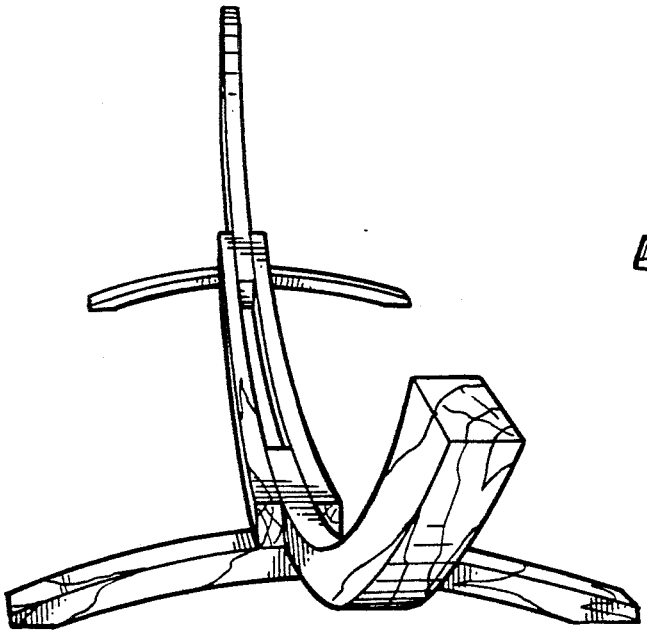
FIG. 2 PRIOR ART
FIG. 2 illustrates an additional hammock stand of the prior art in assembled upright configuration.
Figure 3:
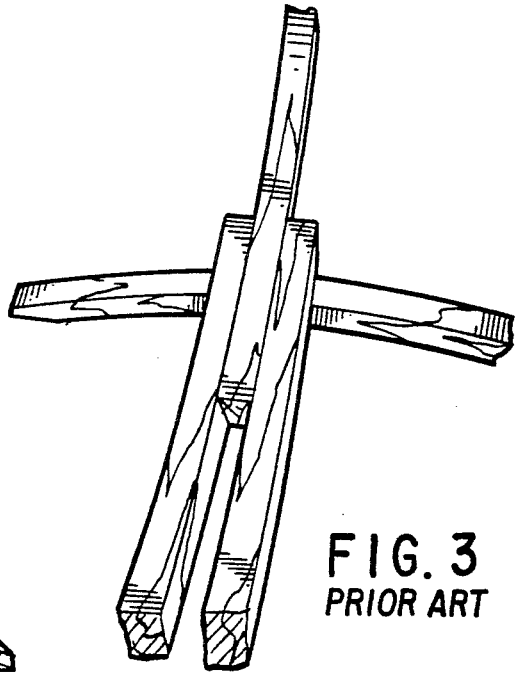
FIG. 3 PRIOR ART
FIG. 3 illustrates in greater detail the assembly of the prior art device of FIG. 2.

Devices of the prior art intended for similar support of hammocks are illustrated in FIGS. 1,2, and 3. While these prior art devices possess certain superficial similarities to the device of the present invention, it will readily be appreciated that the device of FIG. 1 requires two extremely large curved sections which overlap to form the single arch. This structure therefore requires a great deal of space for transportation in the disassembled configuration since the length of the large curved pieces is of necessity much greater than in the present invention. It will be appreciated that FIG. 1 provides illustration of the means of attachment of the ends of the hammock to the respective ends of the arch in a manner similar to that used in applicant's invention.

FIGS. 2 and 3 illustrate an additional structure of the prior art which has attempted to avoid the problems associated with the structure of FIG. 1 by providing a four section structure in which the two end sections are sandwiched respectively between two parallel central pieces. While the configuration of FIG. 2, and 3 avoid the long curved sections shown in FIG. 1 it does so by providing a larger number of pieces having greater weight and therefor also contributing to the problems of shipping prior to assembly.

In contrast to the devices of the prior art the present invention provides a structure which combines both smallness of size when disassembled without substantially increasing the weight due to using additional sections. Further, the device of the present invention possesses smooth unbroken lines when assembled to thereby resemble more closely a complete unitary arch as opposed to the devices of the prior art which have a broken irregular appearance owing to their overlapping structures.

It is claimed:

1. A stand for supporting a hammock in suspended configuration above the ground comprising a curved, elongated composite member consisting of a curved central section in interlocking engagement at each of its ends with one end each of two respective curved end sections to form a unitary, upturned arch; said interlocking engagement in which a narrower tongue portion at the ends of the central section engages within a complimentary groove at the end portion of the complementary end section to form said unitary upturned arch having continuous, uninterrupted and unbroken sides said tongue and groove engagement being reinforced by fastener means; said unitary composite member having a plurality of elongated support means mounted transverse thereto to maintain said member in an upright orientation; and each of said end sections being provided at its unattached end with means for attaching one end of a hammock.

2. The stand of claim 1 which is provided with two of said support means.

* * * * *